United States Patent [19]

Kerley

[11] Patent Number: 4,492,221

[45] Date of Patent: Jan. 8, 1985

[54] DEVICE FOR RELAXING AND REFRESHING HANDS OR FEET

[76] Inventor: Eddie F. Kerley, 3313 Bildahl St., Rockford, Ill. 61109

[21] Appl. No.: 467,735

[22] Filed: Feb. 18, 1983

[51] Int. Cl.[3] ..... A61H 21/00

[52] U.S. Cl. ..... 128/24.1; 128/34; 128/362

[58] Field of Search ..... 128/24.1, 25 B, 65, 128/66, 24.2; 272/96; 604/291

[56] References Cited

U.S. PATENT DOCUMENTS

| | | | |
|---|---|---|---|
| 2,800,897 | 7/1957 | Ross | 128/34 |
| 2,913,833 | 11/1959 | Glintz | 128/24.1 |
| 3,283,756 | 11/1966 | Turley | 128/25 B |
| 3,366,105 | 1/1968 | Sadowski et al. | 128/24.1 |
| 3,683,896 | 8/1972 | Peplin | 128/25 B X |
| 3,837,334 | 9/1974 | Johnson | 128/25 B X |
| 3,890,963 | 6/1975 | Patterson | 128/24.1 |

*Primary Examiner*—Robert A. Hafer
*Assistant Examiner*—Chris Coppens
*Attorney, Agent, or Firm*—Leydig, Voit, Osann, Mayer & Holt, Ltd.

[57] ABSTRACT

The device includes a platform mounted on a base and adapted to support a person's hands or feet in side-by-side relation. A slotted plate defines left and right sets of air-directing channels between the platform and the base. A rotatable impeller circulates air through a manifold and into the channels with the air being discharged upwardly from the channels and through ports in the platform to relax and refresh the hands or feet. A weight attached to one of the blades of the impeller causes the platform to vibrate and further induce relaxation.

13 Claims, 4 Drawing Figures

DEVICE FOR RELAXING AND REFRESHING HANDS OR FEET

BACKGROUND OF THE INVENTION

This invention relates to a device for relaxing and refreshing a person's hands or feet. More particularly, the invention relates to a device which treats the hands or feet by circulating air past the hands or feet. One device which is designed to circulate air past the toes of a person's feet is disclosed in Sadowski et al. U.S. Pat. No. 3,366,105.

SUMMARY OF THE INVENTION

The general aim of the present invention is to provide a new and relatively simple and inexpensive device for treating a person's hands or feet with circulating air, the device being capable of inducing more complete relaxation throughout the limb and being capable of acting in a more gentle manner than prior devices.

A more detailed object of the invention is to achieve the foregoing by providing a device in which air is circulated through several distinct channels and out of appropriately located ports and is directed specifically either along the toes and the arch of a foot or along the fingers and palm of a hand in order to provide relaxation by gently stimulating those relatively sensitive areas of the limbs.

The invention also resides in the novel manner in which the channels are formed in the device and in the unique location of the ports.

A further object of the invention is to provide a device in which the air is circulated by an impeller which also induces gentle vibration into the device in order to massage the hands or feet while the hands or feet are being refreshed by the circulating air.

These and other objects and advantages of the invention will become more apparent from the following detailed description when taken in conjunction with the accompanying drawings.

DETAILED DESCRIPTION OF THE PREFERRED EMBODIMENTS

Figure 1:
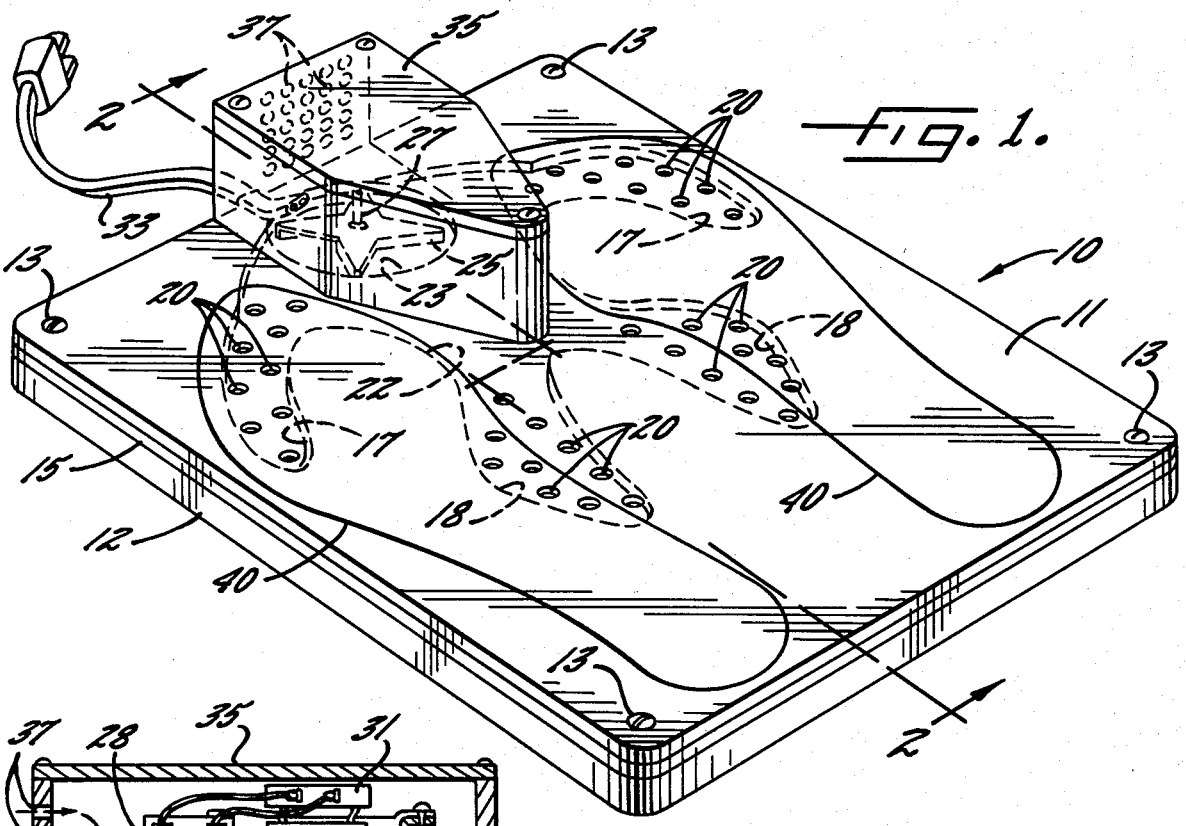
FIG. 1 is a perspective view of one embodiment of a new and improved device incorporating the unique features of the present invention, the device being particularly adapted to relax and refresh a person's feet.
Figure 2:
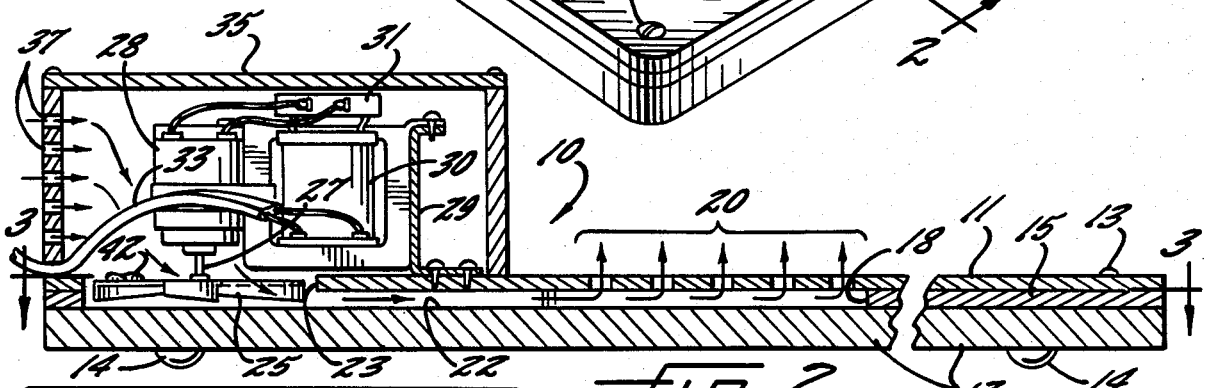
FIG. 2 is a cross-sectional view taken substantially along the line 2—2 of FIG. 1.
Figure 3:
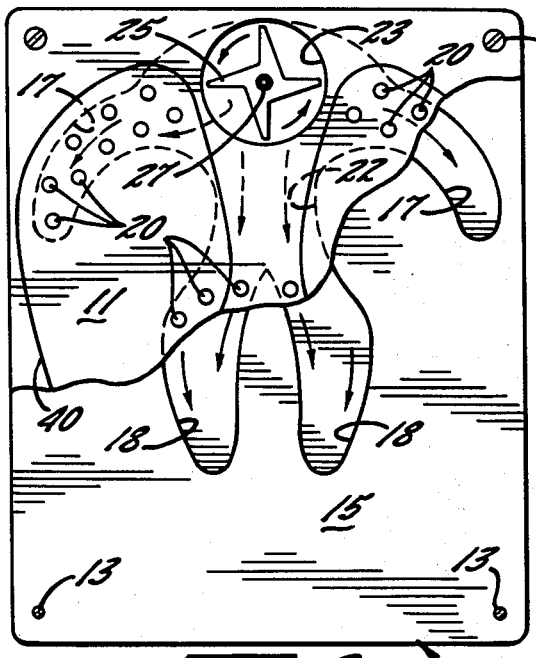
FIG. 3 is a cross-sectional view, on a reduced scale, as taken substantially along the line 3—3 of FIG. 2.

The device 10 which has been shown in FIGS. 1 to 3 is particularly adapted to refresh and relax a person's feet. In the present instance, the device comprises an upper horizontal platform 11 which preferably is formed by a flat and rigid sheet of transparent plastic. The platform is generally rectangular in shape and is of sufficient length and width to enable a person's feet to rest on the platform in side-by-side relation.

Underlying the platform 11 is a supporting base 12 which may be made of wood or plastic. Screws 13 extend through holes adjacent the corners of the platform and are threaded into the base to secure the platform to the base. Four anti-skid pads 14 (FIG. 2) are fastened to the lower side of the base adjacent the corners thereof to elevate the base and to prevent the base from slipping.

In accordance with the present invention, the feet are refreshed and relaxed by air which first is circulated through unique channels between the platform 11 and the base 12 and then is directed across the toes and along the arch of each foot. By virtue of being circulated through the channels, the air is concentrated at the more sensitive areas of each foot and induces gentle relaxation of the entire foot.

More specifically, the channels are formed in a flat plate 15 which is sandwiched between the platform 11 and the base 12, the plate being held in place by the screws 13. In carrying out the invention, the plate coacts with the platform and the base to form a left set of channels for the left foot and a right set of channels for the right foot. Thus, each set of channels includes a generally laterally extending channel 17 which is curved to underlie the toes of the respective foot. In addition, each set of channels includes a generally longitudinally extending channel 18 which underlies the inner side of the arch of the foot. The channels are formed by cutting slots through the plate 15 with the upper and lower sides of the slots being closed by the platform 11 and the base 12, respectively.

The channels 17 and 18 of the two sets are positioned symmetrically on opposite sides of the longitudinal centerline of the platform 11, one set of channels being a mirror image of the other set. Ports 20 are formed through the platform 11 and overlie the channels 17 and 18 so that air circulated through the channels may be emitted from the ports in the form of upwardly directed air streams for gently stimulating the toes and arches.

One end of each of the channels 17 and 18 communicates with a central manifold 22 which is formed by cutting a central hole through the plate 11. The lower side of the manifold 22 is closed by the base 12 while the upper side of the manifold is closed by the platform 11 except near the forward end of the manifold where a circular hole 23 is formed through the platform. A rotary impeller 25 with four angularly spaced blades is disposed in the hole 23 and is located with its lower end spaced a short distance below the lower side of the platform 11.

The impeller 25 is adapted to be rotated by the shaft 27 (FIG. 2) of an electric motor 28 located above the platform 11 and secured thereto by a mounting bracket 29. Herein, the motor is a 6 volt d.c. motor which is energized by way of a transformer 30 and a full wave bridge rectifier 31 on the bracket 29. The transformer is adapted to be connected to a 115 volt a.c. voltage source by a cord 33 and reduces the voltage to 6 volts before the rectifier converts the alternating current voltage to direct current voltage for energizing the motor.

The device 10 is completed by an inverted cup-shaped housing 35 which encloses the motor 28 and covers the hole 23, the housing being fastened to the platform 11 by screws (not shown). Several openings 37 (FIG. 2) are formed in one wall of the housing 35 to enable the impeller 25 to draw air into the housing and to direct the air through the hole 23 and into the manifold 22 and the channels 17 and 18 for discharge out of the ports 20.

With the foregoing arrangement, a person places his feet in side-by-side relation on the platform 11 with the toes of each foot overlying the respective channel 17 and with the inner side of the arch of each foot extending above the respective channel 18. To facilitate proper placement of the feet, an outline of each foot may be printed on the underside of the transparent platform 11 as indicated at 40 in FIG. 1.

When the motor 28 is energized, the rotatable impeller 25 draws air into the housing 35 and circulates the air through the manifold 22 and into the channels 17 and 18. The air is discharged upwardly in discrete streams through the outlet ports 20 and circulates past the toes and arch of each foot. Such circulation refreshes and relaxes the sensitive areas of the feet with a gentle, stimulating action. The effect of the air acting on the feet not only refreshes the feet but also has been found to help relieve the pain of arthritis in the lower extremities.

The platform 11 preferably is vibrated gently to further induce relaxation of the feet. Herein, the vibration is imparted to the platform in an extremely simple manner by securing a small weight 42 (e.g., a drop of solder) to one of the blades of the impeller 25 as shown in FIG. 2. The weight 42 causes the impeller to be angularly unbalanced and to impart gentle vibration to the platform. Gentle vibration is preferred over more vigorous vibration in order to induce a relaxing effect without causing pronounced shaking of the feet and to allow comfortable use of the device 10 for a longer period of time.

Figure 4:
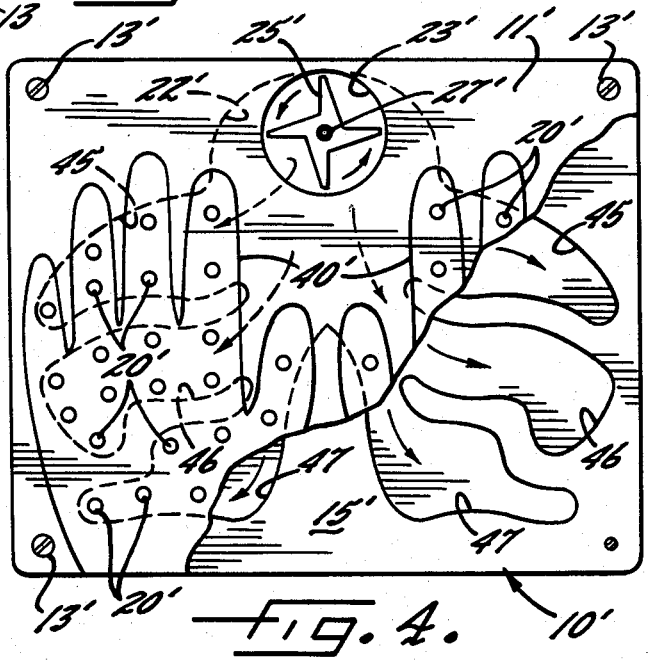
FIG. 4 is a view similar to FIG. 3 but shows a modified device which is particularly adapted to relax and refresh a person's hands.

Another device 10' incorporating the features of the invention is shown in FIG. 4 in which parts corresponding to the device 10 of the first embodiment are indicated by the same but primed reference numerals. The device 10' is particularly adapted to relax and refresh a person's hands.

Thus, the underside of the platform 11' of the device 10' is printed with outlines 40' which are shaped generally as left and right hands. Each set of channels includes a first generally laterally extending channel 45 which underlies the fingers of the respective hand. Another laterally extending channel 46 extends beneath the midportion of the palm of the hand. A third channel 47 includes a generally longitudinally extending portion which underlies the thumb and further includes a generally laterally extending portion which underlies the heel of the palm. The device 10' functions in the same manner as the device 10 but serves to relax and refresh the hands.

I claim:

1. A device for relaxing and refreshing left and right terminal limbs having digits, said device comprising an upper, generally horizontal platform of sufficient length and width to enable left and right limbs to rest on the platform in side-by-side relation, a lower base underlying and supporting said platform, means defining left and right sets of channels between said platform and said base, each of said sets comprising at least two distinct channels positioned to underlie different areas of the respective limb, a manifold between said platform and said base and communicating with all of said channels, said means comprising a plate sandwiched between said platform and said base, slots formed through said plate and defining said channels, an opening formed in said plate and defining said manifold, the upper and lower sides of said slots and said opening being closed by said platform and said base, respectively, a hole formed in said platform above said manifold, a rotatable impeller alined with said hole and operable when rotated to circulate air in said manifold and into said channels, a motor for rotating said impeller, and ports formed through said platform and overlying said channels whereby upwardly directed air streams are emitted from said ports to relax and refresh said limbs.

2. A device as defined in claim 1 in which said impeller is located within said hole, the lower end of said impeller being located below the lower side of said platform.

3. A device as defined in claim 1 in which the channels of said left set are a mirror image of the channels of said right set.

4. A device as defined in claim 1 in which the channels of said left set and the channels of said right set are located symmetrically with respect to the longitudinal centerline of said platform.

5. A device as defined in claim 1 for relaxing and refreshing left and right feet, each set of channels having a generally laterally extending channel positioned to underlie the toes of the respective foot and having a generally longitudinally extending channel positioned to underlie the inner side of the arch of the respective foot.

6. A device as defined in claim 1 for relaxing and refreshing left and right hands, each set of channels having a generally laterally extending channel positioned to underlie the fingers of the respective hand and having another generally laterally extending channel positioned to underlie the palm of the respective hand.

7. A device as defined in claim 6 in which each set of channels further includes a third channel positioned to underlie both the thumb and the palm of the respective hand.

8. A device as defined in claim 1 further including means for causing said impeller to impart vibration to said platform.

9. A device as defined in claim 8 in which said impeller comprises a plurality of angularly spaced blades, said last-mentioned means comprising a weight attached to one of said blades to cause said impeller to be angularly unbalanced and to vibrate said platform.

10. A device as defined in claim 1 further including a housing on the upper side of said platform, said motor being enclosed in said housing, and openings in said housing to enable said impeller to draw air into said housing for circulation through said manifold and said channels.

11. A device for relaxing and refreshing left and right feet, said device comprising an upper, generally horizontal platform of sufficient length and width to enable left and right feet to rest on the platform in side-by-side relation, a lower base underlying and supporting said platform, a plate sandwiched between said platform and said base, left and right sets of slots formed through said plate and having upper and lower sides closed by said platform and said base, respectively, each set of slots comprising a generally laterally extending slot positioned to underlie the toes of the respective foot and further comprising a generally longitudinally extending slot positioned to underlie the inner side of the arch of the respective foot, an opening formed through said plate and defining a manifold communicating with all of said slots, a hole formed in said platform above said opening, a rotatable impeller alined with said hole and operable when rotated to circulate air said aid opening and into said slots, a motor for rotating said impeller, and ports formed through said platform and overlying said slots whereby upwardly directed air streams are emitted from said ports to relax and refresh said feet.

12. A device for relaxing and refreshing left and right hands, said device comprising an upper, generally horizontal platform of sufficient length and width to enable left and right hands to rest on the platform in side-by-side relation, a lower base underlying and supporting said platform, a plate sandwiched between said platform and said base, left and right sets of slots formed through said plate and having upper and lower sides closed by said platform and said base, respectively, each set of slots comprising a generally laterally extending slot positioned to underlie the fingers of the respective hand and further comprising another generally laterally extending slot positioned to underlie the palm of the respective hand, an opening formed through said plate and defining a manifold communicating with all of said slots, a hole formed in said platform above said opening, a rotatable impeller alined with said hole and operable when rotated to circulate air in said opening and into said slots, a motor for rotating said impeller, and ports formed through said platform and overlying said slots whereby upwardly directed air streams are emitted from said ports to relax and refresh said hands.

13. A device as defined in claim 12 in which each set of slots includes a third slot positioned to underlie both the thumb and the palm of the respective hand.

* * * * *